US005244303A

United States Patent [19]

Hair

[11] Patent Number: 5,244,303

[45] Date of Patent: Sep. 14, 1993

[54] INTERLOCKING PAVING STONE

[76] Inventor: Roberta A. Hair, 7554 Wooster Rd., Cincinnati, Ohio 45227

[21] Appl. No.: 869,756

[22] Filed: Apr. 16, 1992

Related U.S. Application Data

[63] Continuation-in-part of Ser. No. 627,485, Dec. 14, 1990, Pat. No. 5,108,219.

[51] Int. Cl.[5] ..... E01C 5/00

[52] U.S. Cl. ..... 404/41; 404/42; 404/44; 52/590; 52/604

[58] Field of Search ..... 404/29, 34, 41, 42, 404/44; 52/589, 590, 593, 604

[56] References Cited

U.S. PATENT DOCUMENTS

| | | | |
|---|---|---|---|
| D. 102,145 | 12/1936 | Parker . | |
| 1,460,516 | 7/1923 | Sheen . | |
| 1,474,779 | 11/1923 | Krammer . | |
| 3,897,164 | 7/1975 | Dodino | 404/41 |
| 3,903,702 | 9/1975 | Appleton | 404/41 X |
| 3,953,009 | 4/1976 | Kan | 52/611 X |
| 4,128,357 | 12/1978 | Barth et al. | 404/41 |
| 4,583,341 | 4/1986 | Barth et al. | 52/589 |
| 4,773,790 | 9/1988 | Hagenah | 404/41 |
| 4,919,565 | 4/1990 | Gopfert | 404/41 |
| 5,035,098 | 7/1991 | Newsom | 52/589 |
| 5,108,219 | 4/1992 | Hair | 404/41 |

FOREIGN PATENT DOCUMENTS

| | | | |
|---|---|---|---|
| 630067 | 7/1963 | Belgium . | |
| 1119315 | 12/1961 | Fed. Rep. of Germany . | |
| 3303210 | 12/1961 | Fed. Rep. of Germany . | |
| 1951581 | 4/1971 | Fed. Rep. of Germany | 404/41 |
| 2253629 | 7/1974 | Fed. Rep. of Germany | 404/41 |
| 2409188 | 9/1975 | Fed. Rep. of Germany . | |
| 7920065 | 2/1980 | Fed. Rep. of Germany . | |
| 2841261 | 4/1980 | Fed. Rep. of Germany . | |
| 3533020 | 3/1987 | Fed. Rep. of Germany | 404/41 |
| 3534992 | 4/1987 | Fed. Rep. of Germany . | |
| 2330828 | 6/1977 | France | 52/589 |
| 6806306 | 11/1968 | Netherlands . | |

*Primary Examiner*—Ramon S. Britts
*Assistant Examiner*—Roger J. Schoeppel
*Attorney, Agent, or Firm*—Wood, Herron & Evans

[57] ABSTRACT

An interlocking paving stone which has in certain embodiments a twelve-sided main section and an eight-sided tail section, and in certain other embodiments, has a twenty-sided main section and a sixteen-sided tail section, which main and tail sections are integral with each other, coplanar, and symmetrical about a longitudinal plane perpendicular to the paving stone which bisects it into two equal longitudinally extending sections. The relationship of the lengths of the sides to each other and angles they define are such that a large number of different interlocking patterns are possible which exhibit a high degree of interlock along both opposite edges and both opposite ends of the stones.

10 Claims, 11 Drawing Sheets

INTERLOCKING PAVING STONE

This application is a continuation-in-part of co-pending application Ser. No. 07/627,485, filed Dec. 14, 1990 in the name of Roberta A. Hair now U.S. Pat. No. 5,108,219.

My invention is directed to uniquely shaped paving stones for covering the ground or other like surfaces. Specifically, my invention is directed to such paving stones which can be combined with other like paving stones in a variety of different orientations to form stable load-carrying surfaces in a multiplicity of different patterns which exhibit a high degree of interlock between adjacent paving stones.

BACKGROUND OF THE INVENTION

Paving stones of differing shapes have been employed in the construction of traffic-carrying surfaces such as roadways, footways, embankments and pool decks. Typically, the paving stones are made of concrete, formed in desired shape in molds, and cured under high pressure where the paving stone material is compacted and hardened into the desired shape in the mold, and removed from the mold and exposed to ambient air to complete the curing cycle. The method by which such paving stones can be made are well known in the art and form no part of my invention. Hence, methods for making paving stones will not be addressed further except to note that the shape of the molds used to form prior art paving stones must be modified so as to conform to the shape of my paving stones. To construct a surface employing paving stones, the undersurface is prepared in known fashion to provide a smooth flat surface upon which to place the paving stones. The paving stones are placed one at a time such that their vertical or peripheral walls or edge faces come into close contact. The gaps between edge faces may be filled either with mortar, concrete, or other such solidifying spacer element, or preferably, with sand which is simply poured into the gaps in a known manner. My invention is ideally suited to the latter, less costly method. The traffic load encountered by surfaces constructed in the above manner can vary from as light as pedestrian traffic to as heavy as several ton trucks and forklifts.

Paving stones employed for traffic surfaces have come in a wide variety of shapes from square and rectangular to multi-sided and irregular shaped surfaces, but a paving stone's shape is known to affect the ground cover's load carrying capacity and durability. When viewed from the top, such paving stones generally fall into one of three basic categories.

The first category is a paving stone which has a known and simple geometric shape, such as a rectangle, a square, a hexagon, or an octagon. This category is less desirable than other categories hereinafter discussed because their shapes preclude an interlock joint between adjacent paving stones. Additionally, proper utilization can require greater material and care than other paving stones and are often not satisfactory in use. For example, if such paving stones were placed in the manner expected of my invention, i.e., with sand between them, the surface would not be stable because there is no interlock. Furthermore, because there is no interlock, long, straight channels are more easily formed between the paving stones thus permitting rain, for example, to wash away the sand further reducing the load carrying stability of the ground cover formed with those paving stones. Hence, such paving stones would typically require mortar or concrete between paving stones. Mortar or concrete are typically more expensive than sand and are more difficult to work with.

A second category of paving stone is one wherein, from a top plan view, the paving stone looks substantially rectangular but the edges are deformed in such a manner as to interlock when laid next to an adjacent, identical stone. Examples of second category paving stones are shown in U.S. Pat. No. 2,919,634 and U.S. Pat. No. 3,494,266. Also included in this category are certain multi-faced irregularly shaped paving stones such as that disclosed in U.S. Pat. No. Des. 82,970. The paving stones disclosed in the aforementioned patents overcome some of the drawbacks of paving stones discussed in the preceding paragraph because they may be interlocked. However, they are less attractive from an aesthetic standpoint.

A third category of paving stone overcomes to some degree the drawbacks of both first and second category paving stones. A third category paving stone is comprised of two or more sections having the shape of first category paving stones which are combined into one integral paving stone. An example, of such a paving stone is disclosed in U.S. Pat No. 4,128,357. The paving stone of that patent has a main section which is of a known octagonal shape, and a tail section which is of a known square shape, with the main and tail sections being formed as one paving stone. Another example of an interlocking paving stone, referred to as a trillium design, is shown in the brochure entitled, "Munich Two Interlocking Paving Stone" from Unilock, Ltd. of Georgetown, Ontario. The trillium design is comprised of three regular hexagonal shaped sections to form a cloverleaf pattern. Such integral paving stones can interlock for durability and stability. A disadvantage, however, is that they are susceptible of only a few different interlocking patterns, and the degree of interlock is limited.

SUMMARY OF THE PRESENT INVENTION

An objective of my invention is to provide a paving stone which lends itself to forming a large number of different interlocking patterns which exhibit a high degree of interlock. This objective has been accomplished by a paving stone having integral coplanar main and tail sections which is symmetrical about a longitudinal plane bisecting the two sections.

The main section in certain embodiments has twelve substantially straight sides including first, second, third and fourth pairs of sides with all of the sides of the pairs being of the same length, and with the two sides of each pair of the first, second, third, and fourth pairs of sides being connected to define internal angles. The first and second pairs of sides are disposed on opposite sides of the plane of symmetry and have internal angles which are equal to each other. The second and fourth pairs of sides are disposed on opposite sides of the main section along the plane of symmetry, while the third and fourth pairs of sides are disposed between the first and second pairs of sides, with the third and fourth pairs of sides being located remote and adjacent the tail section, respectively. The angles defined by the sides of the first and second pairs of sides are equal to each other, and the angles defined by the sides of the third and fourth pairs are equal to each other. The main section further includes first, second, third and fourth equal length intermediate sides which are not connected to each other. The first and second intermediate sides are parallel to each other and the third and fourth intermediate sides are parallel to each other. The first and third intermediate sides, which are remote from the tail section, are located on opposite sides of and symmetrical to the plane of symmetry, with the third pair of sides being located between said first and third intermediate sides. The second and fourth intermediate sides extend from said tail section and are disposed on opposite sides of and symmetrical to the plane of symmetry, with the fourth pair of sides being located between said second and fourth intermediate sides.

The tail section of the embodiments described in the preceding paragraph includes eight substantially straight equal length interconnected sides which are equal in length to the sides of said first, second, third and fourth pairs of sides of said main section. The eight tail section sides define first, second, third and fourth pairs of sides, with each pair defining an external angle. The first and second pairs of sides of the tail section are on opposite sides of and symmetrical to the plane of symmetry. The third and fourth pairs of sides of the tail section are located along the plane of symmetry between said first and second pairs of sides of the tail section, with said fourth pair of sides adjacent the main section and common to the fourth pair of sides of said main section. The third pair of sides of the tail section are located between said first and second pairs of sides of the tail section and remote from the main section.

The internal angles defined by said first and second pairs of sides of the main section are substantially equal to the external angles defined by said first and second pairs of sides of said tail section, and the internal angles defined by the third and fourth pairs of sides of the main section are substantially equal to the external angles defined by the third and fourth pairs of sides of the tail section. Additionally, each of the fourth pairs of sides of the main and tail sections is internal to the paving stone whereby it is not exposed, while each of the first, second and third pairs of sides of the main and tail sections is external to the paving stone whereby it is exposed. Finally, the angles defined by the first, second, third and fourth pairs of sides of the main and tail sections are in a range collectively defined by the subranges of approximately 120°-165° and 195°-240°, thereby providing, when plural paving stones are disposed in a pattern, a high degree of interlock between adjacent stones along both the edge faces thereof which intersect the plane of symmetry, that is, at opposite ends of the paving stones, and the edge faces thereof which are displaced from the plane of symmetry, that is, the opposite sides of the paving stone.

In a preferred embodiment, the internal angles defined by the first, second, third and fourth pairs of sides of the main section and the external angles defined by the first, second, third and fourth pair of sides of said tail section are all substantially equal to each other, and the intermediate sides are angled at substantially 45° to the plane of symmetry, thereby enabling the paving stones to be laid in a true herringbone pattern.

Preferably, the ratio of the length of the intermediate sides of the main section to the remaining sides of the main section is in the approximate range of $\frac{1}{4}$:1-2:1, with a ratio of $1\frac{3}{8}$:1 being the most preferred. Additionally, it is preferred to limit the overall length to less than approximately 10" and the overall width to less than approximately 5" to facilitate easy gripping by hand when the paving stones are laid manually.

In another embodiment of the invention each side of the pairs of sides of the main section of the embodiment described above is replaced with two sides such that each pair of sides of the main section of the above-described embodiment is constituted by a set of four sides providing a twenty-sided main section. Similarly, in the tail section, each of the eight sides is replaced by a pair of sides, providing a sixteen-sided tail section. Thus, a thirty-six-sided paver is provided, with four sides of both the tail and main sections being common and unexposed, leaving a total of sixteen main section sides exposed and twelve tail section sides exposed. In this embodiment, the internal angles of adjacent pairs of each four-sided set of the main section and the external angles of adjacent pairs of each four-sided set of the tail section are in the range collectively defined by the subranges of approximately 120°-165° and approximately 195°-240°, thereby assuring a satisfactory degree of interlock between adjacent pavers.

BRIEF DESCRIPTION OF THE DRAWINGS

The foregoing advantages, objectives and features of the invention will become more readily apparent from a detailed description of the preferred embodiment thereof taken in conjunction with the drawings in which.

DETAILED DESCRIPTION OF A PREFERRED EMBODIMENT

Figure 1:
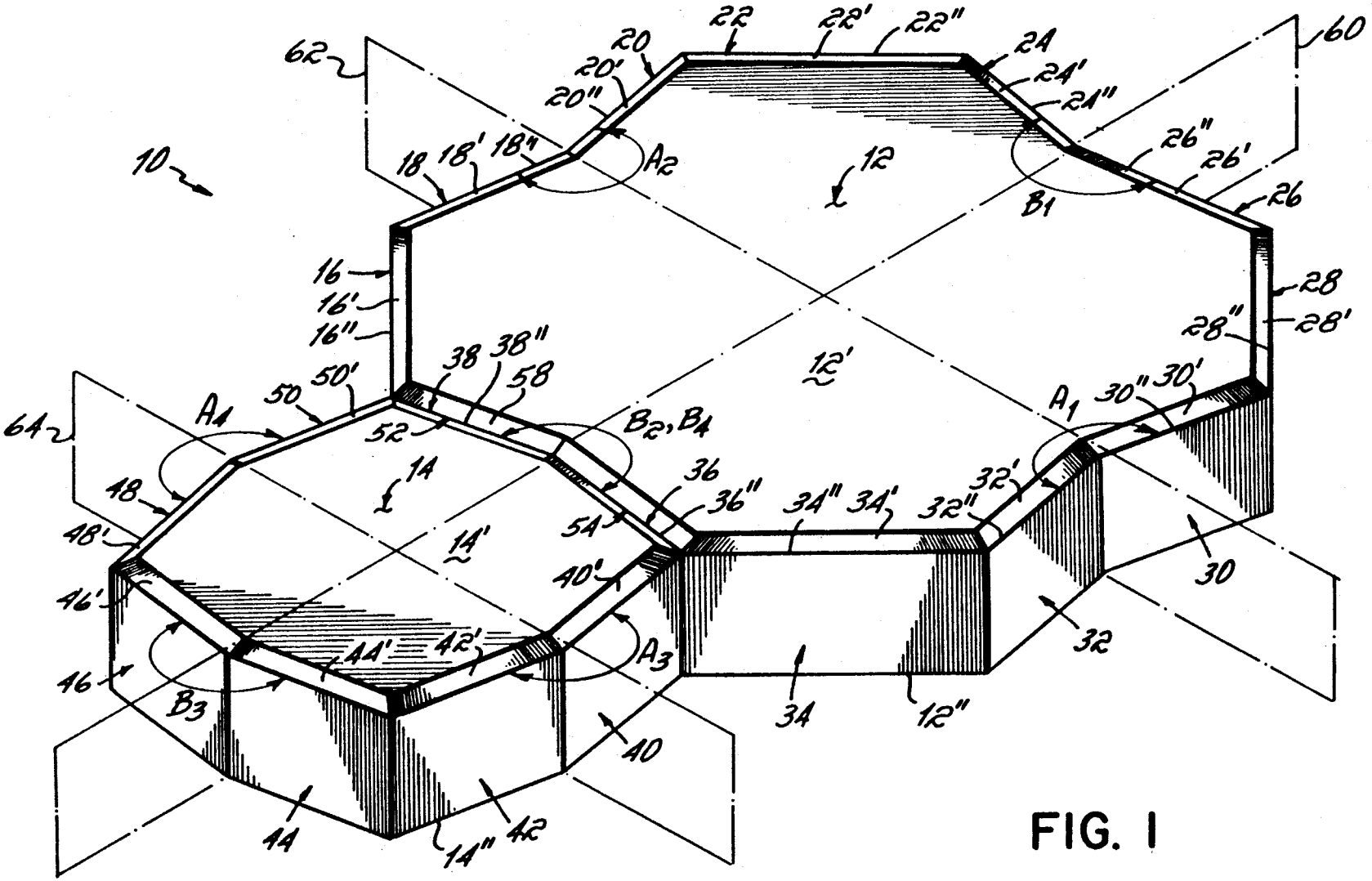
FIG. 1 is a perspective view of one preferred embodiment of the paving stone of this invention in which the opposite sides of the main section thereof are concave, with the ratio of the lengths of the long and short side segments thereof being approximately $1\frac{3}{8}$:1.

With reference to FIG. 1 the paving stone 10 is seen to include a major or main section 12 and a smaller or minor section 14 which is referred to hereinafter as the tail section. The top surface 12' of the main section 12 and the top surface 14, of the tail section 14 are substantially planar, with the top surfaces 12', 14' being coplanar with respect to each other. Similarly, the bottom surfaces 12" and 14" of the main section 12 and tail section 14, respectively, are each substantially planar, with the bottom surfaces of the main and tail sections being coplanar with respect to each other. The main and tail sections 12, 14 have substantially uniform thicknesses throughout measured between the top and bottom surfaces thereof and are integral with respect to each other.

The main section 12 of the paving stone 10 has twelve side surfaces or faces 16, 18, 20, 22, 24, 26, 28, 30, 32, 34, 36, 38. Side faces or surfaces 16-34 are external with respect to the paving stone 10 in the sense that they are exposed to the environment. Side faces 36, 38 of the main section 12 of the paving stone 10 are internal with respect to the paving stone in sense that they are not exposed to the environment. The tail section 14 of the paving stone 10 has eight side surfaces or faces 40, 42, 44, 46, 48, 50, 52, 54. Side faces 40-50 of the tail section 14 are external with respect to the paving stone 10 in the sense that they are exposed to the environment. Side faces 52, 54 of the tail section 14 are internal in the sense that they are not exposed to the environment. Side faces 52, 54 of the tail section 14 are spatially coincident with side faces 38, 36, respectively, of the main section 12. All side faces 16-54 of the paving stone are generally perpendicularly disposed with respect to the plane of the top surfaces 12', 14' and bottom surfaces 12", 14" of the paving stone 10.

Preferably, the upper edges 16', 18', 20', 22', 24', 26', 28', 30', 32', 34' of the top surface 12' of main section 12, which are exposed to the environment, are beveled. Similarly, the upper edges 40', 42', 44', 46', 48', 50' of the top surface 14' of tail section 14, which are exposed to the environment, are preferably beveled. Beveling of these edges provides two advantages should the paving stones, when laid in a pattern be uneven, that is, not all identically located in the same plane. First, the unevenness will not be as apparent from a visual standpoint. Second, if proximately located edges of adjacent stones are not parallel to each other and in the same horizontal plane, one is not likely to "stub a toe" when walking upon the paving stone pavement.

Preferably, a false joint 58 is provided in the upper surfaces 12', 14' of the main section 12 and tail section 14 at their interface collectively defined by spatially coincident faces or sides 38, 52 and spatially coincident faces or sides 36, 54. The false joint 58 is established by providing a V-shaped groove in the upper surface of the paving stone centered along the interfaces of internal faces or sides 38, 52 and 36, 54.

The paving stone 10 is preferably fabricated of compressed concrete, using a molding process in which the main and tail sections 12, 14 are integral with each other such that the paving stone 10 constitutes a unitary entity. Alternatively, the material from which the paving stone 10 is fabricated can be brick, ceramic, plastic resin, rubber, or the like, providing it provides sufficient durability for its intended use as a pavement on which individuals can walk, bicycle, and/or ride in motor vehicles.

The preferred embodiment of the paving stone 10, as shown in FIG. 1, has a longitudinal plane of symmetry 60 which bisects the main section 12 into two equal mirror image sections and bisects the tail section 14 into two equal mirror image sections. The main section 12 and the tail section 14 are symmetrical with respect to the longitudinal plane 60. The main section 12 has a minor plane of symmetry 62 which is perpendicular to the longitudinal plane 60 of the paving stone. The main section 12 is also symmetrical with respect to the minor plane of symmetry 62. Similarly, the tail section 14 has a minor plane of symmetry 64 which is perpendicular with respect to the longitudinal plane of symmetry 60 of the paving stone 10. The tail section 14 is, in addition to being symmetrical with respect to the longitudinal plane 60 of the paving stone, is also symmetrical with respect to the minor plane of symmetry 64 of the tail section.

Considering the main section 12 in more detail, it will be noted that the side faces of the main section 12 can be viewed as consisting of a first pair of side faces 30, 32 which collectively define an internal angle $A_1$ which is bisected by minor plane of symmetry 62 of the main section 12. Oppositely disposed from the first pair of side faces is a second pair of side faces 18, 20 which collectively define an internal angle $A_2$ which is bisected by the minor plan of symmetry 62 of the main section 12. The main section 12 is provided with a third pair of side faces 24, 26 which collectively define an internal angle $B_1$ which is bisected by the longitudinal plane of symmetry 60. Similarly, the main section 12 has it side faces 36, 38 defining with respect to the main section, an internal angle $B_2$ which is also bisected by the longitudinal plane 60. The tail section 14 includes a first pair of side faces 40, 42 which define an external angle $A_3$ which is bisected by minor plane of symmetry 64. Side faces 48, 50 of the tail section 14 collectively establish a second pair of side faces for the tail section which define an external angle $A_4$ bisected by plane 64. The tail section 14 also includes a third pair of side faces 44, 46 which collectively define an external angle $B_3$ which is bisected by the longitudinal plane 60. The tail section 14 further includes a fourth pair of side faces 52, 54 which collectively define, with respect to the tail section 14, an external angle $B_4$ which is bisected by the longitudinal axis 60. Since the fourth pair of side faces 52, 54 of the tail section are spatially coincident with the fourth pair of side faces 38, 36 of the main section 12, the angles $B_4$, $B_2$ respectively defined thereby, are coincident with each other and, hence, equal.

The main section 12, in addition to the paired side faces 30 and 32, 18 and 20, 24 and 26, and 36 and 38, which define the first, second, third and fourth pairs of sides described above, include the side faces 16, 22, 28, 34 which are located between the paired side faces. Specifically, intermediate side face 28 is located between the first pair of side faces 30, 32 and the third pair of side faces 24, 26, intermediate side face 22 is located between the third pair of side faces 26, 24 and the second pair of side faces 18, 20, intermediate side face 16 is located between the second pair of side faces 18, 20 and the fourth pair of side faces 36, 38, and intermediate side face 34 is located between the first pair of side faces 32, 30 and the fourth pair of side faces 36, 38.

For purposes of providing a symmetrical main section 12, the length of paired side faces 18 and 20, 24 and 26, 30 and 32, 36 and 38 measured along the upper edges thereof 32" and 30", 26" and 24", 20" and 18", 38" and 36", respectively, are substantially equal to each other. Similarly, the length of the intermediate side faces 28, 22, 16, 34, which separate the paired side faces, have substantially equal lengths as measured along their respective upper edges 28", 22", 16", 34". As a consequence of the foregoing relationships of the side faces and their respective lengths, the planes of intermediate side faces 28, 22, 16, 34 are disposed at an angle of approximately 45° with respect to the longitudinal plane 60 of the paving stone 10 and the minor plane 62 of main section 12.

Figure 10:
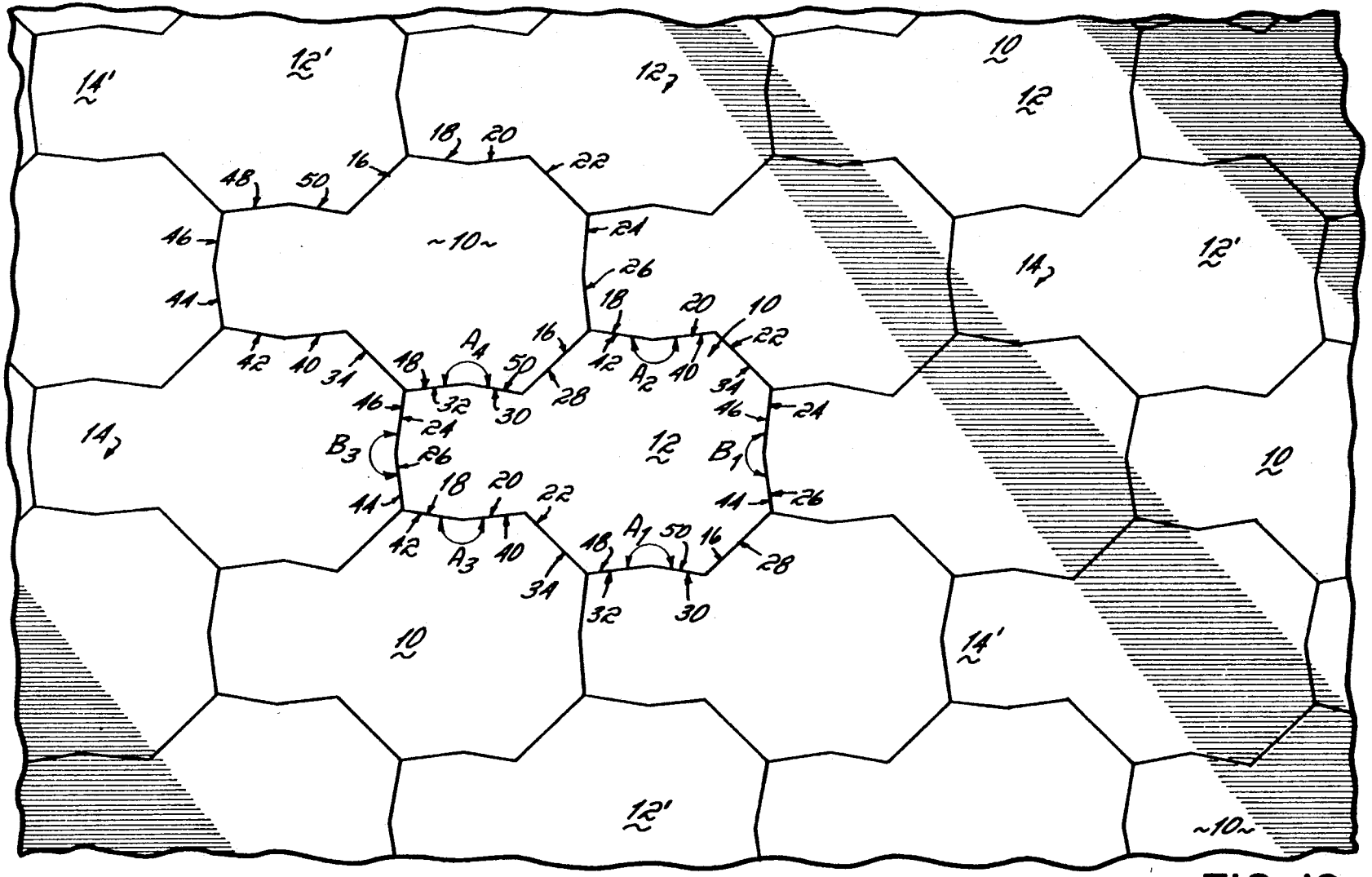
FIG. 10 is a top plan view of a runner pattern laid with the paving stone of FIG. 1 of this invention.

In a runner pattern of the type shown, for example, in FIG. 10, adjacent stones exhibit two specific relationships, namely, the first and second pairs of sides 30, 32 and 18, 20 of the main section 12 of one stone interlockingly fit with the second pair of sides 48, 50 and first pair of sides 40, 42 of the tail section 14 of an adjacent stone, and the third pair of sides 44, 46 of the tail section 14 of one stone interlockingly fit with the third pair of sides 24, 26 of the main section of an adjacent stone. Stated differently, the opposite sides of the main section of one stone interlockingly mesh with the sides of the tail section of two other stones which are on either side of it, and the end of the main and tail sections of one stone interlockingly mesh with the end of the tail and main sections of two adjacent stones which are proximate its opposite ends. To enable the first and second pairs of sides 30, 32 and 18, 20 of the main section of one stone to mesh with the second and first sides 48, 50 and 40, 42 of the tail sections of the adjacent stones, it is essential that the length of the sides 18, 20, substantially equal the length of sides 42, 40, respectively; the length of the sides 48 and 50 substantially equal the length of the sides 32 and 30, respectively; and that the angles (FIG. $A_1$ and $A_2$ substantially equal angles $A_4$ and $A_3$, respectively. To enable the third pair of sides 44, 46 of the end of the tail section 14 of one stone to mesh with the third pair of sides 26, 24 of the end of the main section 12 of an adjacent stone, it is essential that the sides 44 and 46 be substantially equal to sides 26 and 24, respectively, and that angles $B_1$ and $B_3$ substantially equal each other.

It is noted that in a runner type pattern of the type shown in FIG. 10 the intermediate side 16 of one stone meshes with the intermediate side 28 of the adjacent stone, and the intermediate side 34 of one stone meshes with the intermediate side 22 of the adjacent stone. Hence, it is essential that intermediate sides 16 and 28 be substantially equal in length and parallel to each other, and that sides 34 and 22 be substantially equal in length and parallel to each other, for the runner pattern of FIG. 10. In a runner pattern in which adjacent courses run in opposite directions, intermediate sides 16, 22, 28, 34 of one stone mesh with sides 16, 22, 28, 34, respectively, of the adjacent stones located on opposite sides thereof.

Figure 11:
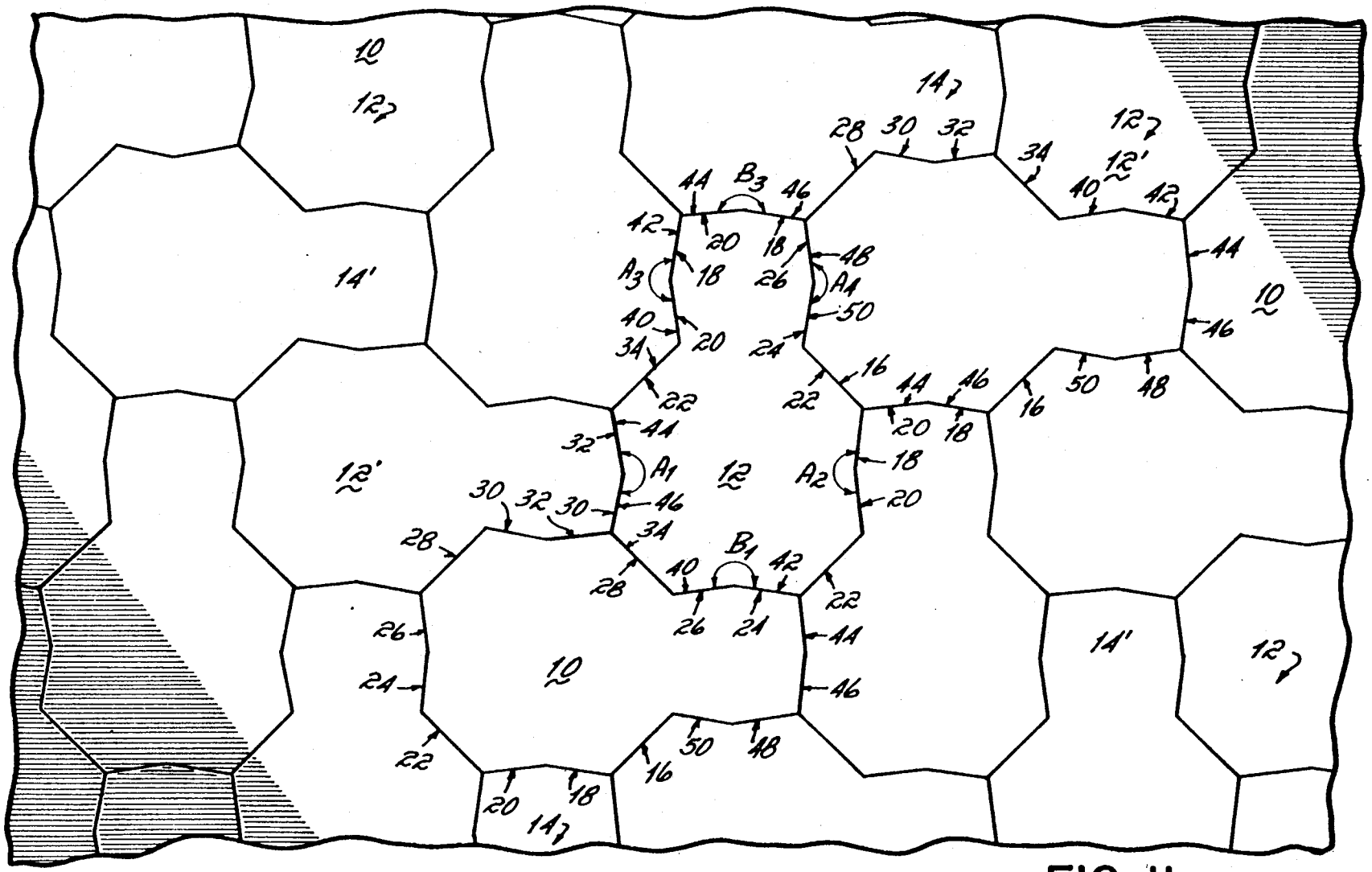
FIG. 11 is a top plan view of a 90° herring-bone pattern laid with the paving stone of FIG. 1 of this invention.
Figure 14:
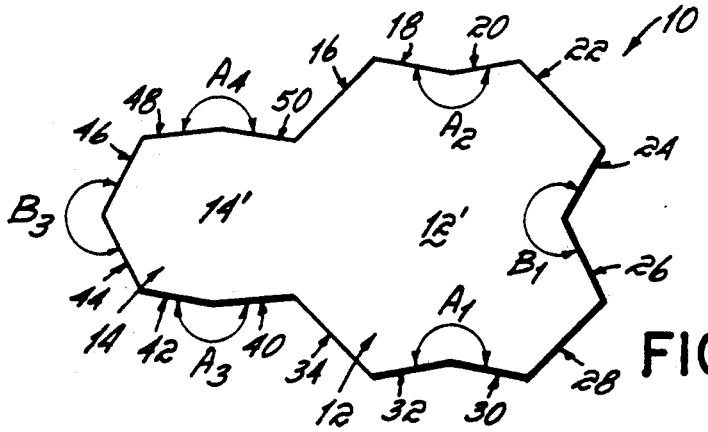
FIG. 14 is a top plan view of a paving stone of this invention susceptive of being laid in runner patterns, but not susceptible of being laid in true herringbone patterns.

The runner pattern of FIG. 10 does not require that the stones be symmetrical about plane 60, although such is preferred since it permits the stone to be laid in a true herringbone pattern of the type shown in FIG. 11 to be described. Also, the runner pattern of FIG. 10 does not require that angles $B_1$ and $B_3$ (which must be substantially equal to each other) be substantially equal to angles $A_1$ and $A_2$ (which must be substantially equal to each other). However, it is preferred that both angles $B_1$ and $B_3$ be substantially equal to angles $A_1$ and $A_2$ to permit true herringbone patterns. Stated differently, if desired the stone of FIG. 14 can be provided, wherein angles $A_1=A_2$ and angles $B_1=B_3$, but angles $A_1$ (and $A_2$)$\neq$angles $B_1$ (and $B_3$). The stone of FIG. 14 can be laid in a runner pattern with all courses in the same direction or in opposite directions, but can not be laid in a herringbone pattern.

In order to use the paving stones of this invention in a true herringbone pattern such as shown in FIG. 11, the following relationships must exist:

(a) the third pair of sides 44, 46 of the tail section 14 of one stone (which define the end of the tail section) must be configured to alternatively interlockingly mesh with the first pair of sides 30, 32 and second pair of sides 18, 20 of the main section (which collectively define the opposite sides of the main section) of adjacent stones;

(b) the first pair of sides of the tail section defined by sides 40, 42 and the second pair of sides of the tail section defined by sides 48, 50 (which collectively define the opposite sides of the tail section) of one paving stone alternatively interlockingly mesh with the third pair of sides 24, 26 of the main section (which define the end of the main section) of adjacent stones; and (c) the first pair of sides 40, 42 of the tail section and the second pair of sides 48, 50 of the tail section (which define the sides of the tail section) of one stone interlockingly mesh with the second pair of sides 18, 20 and the first pair of sides 26, 24 of the main section 12 of adjacent stones.

For a single paving stone 10 of this invention laid in a true herringbone pattern, such as shown in FIG. 11, there are two relationships of the type set forth above as (a) in the preceding paragraph, two relationships of the type set forth as (b), and two relationships of the type set forth as (c). In addition, the intermediate side 16, 22, 28, 34 of the main section of one stone will be in confronting relationship with different ones of the intermediate sides 16, 22, 28, 34 of four different stones.

In a true herringbone pattern, such as shown in FIG. 11, to enable the third pair of sides 44, 46 which define the end of the tail section to mesh with either the first pair of sides 30, 32 or the second pair of sides 18, 20 which define the opposite sides of the main section of an adjacent stone, it is essential that angles $A_1$ and $A_2$ substantially equal angle $B_3$ and that the length of the sides of the first pair 30, 32 and of the second pair 18, 20 of the main section substantially equal the length of the sides 44, 46 which define the end of the tail section. To enable the first pair of sides 40, 42 and the second pair of sides 48, 50 which collectively define the sides of the tail section 14 to interlockingly fit with the third pair of sides 24, 26 which collectively define the end of the main section 12, it is essential that angles $A_3$ and $A_4$ substantially equal angle $B_1$ and that sides 24, 26 substantially equal in length the length of sides 48, 50, 40, 42.

Finally, in the true herringbone pattern of FIG. 11, to enable the first pair of sides 40, 42 of the tail section and the second pair of sides 48, 50 of the tail section, which collectively define the opposite sides of the tail section, to interlockingly mesh with the second pair of sides 18, 20 and the third pair of sides 26, 24 of the main section, it is essential that angles $A_3$, $A_4$, A $B_1$ all be substantially equal to each other, and that sides 40, 42, 48, 50 of the tail section substantially equal in length that of sides 30, 32, 18, 20 of the main section. It is also essential that the intermediate sides 16, 22, 28, 34 have lengths which are all substantially equal to each other.

For the herringbone pattern of FIG. 11, it is also essential that the sides 16, 22, 28, 34 of the main section 12 be angled at 45° with respect to the longitudinal plane of symmetry 60 and the minor plane of symmetry 62 of the main section (shown in FIG. 1).

Figure 12:
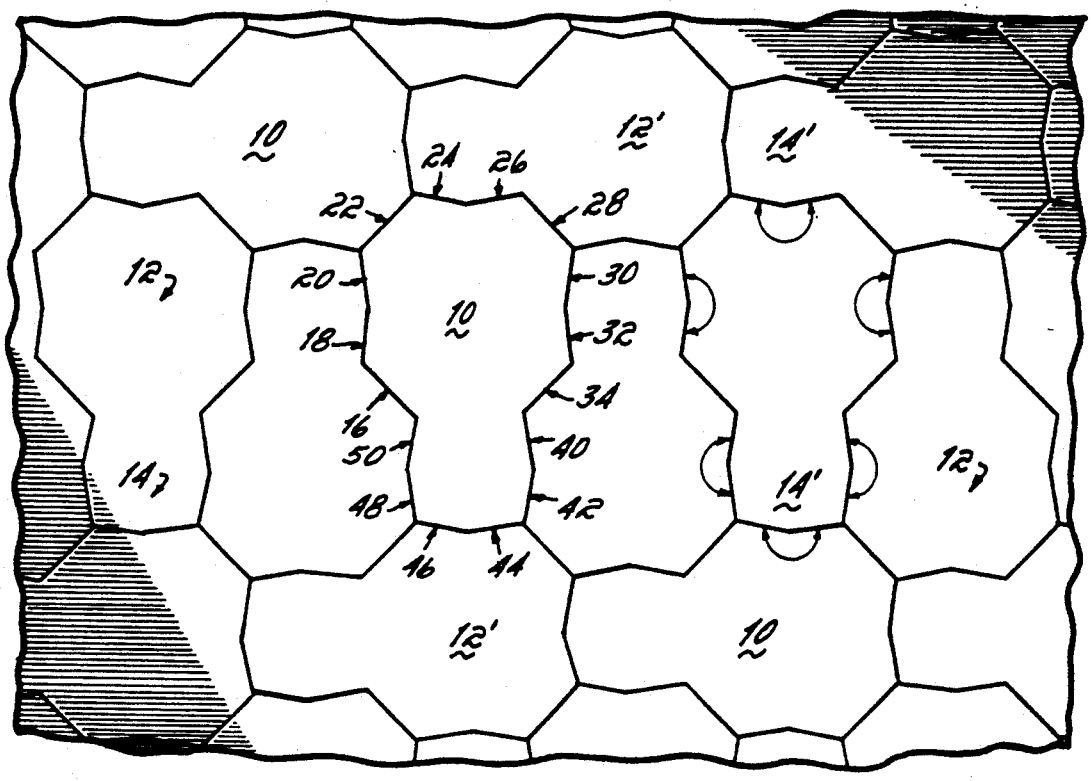
FIG. 12 is a top plan view of a basquet weave or parquet pattern laid with the paving stone of FIG. 1 of this invention.
Figure 13:
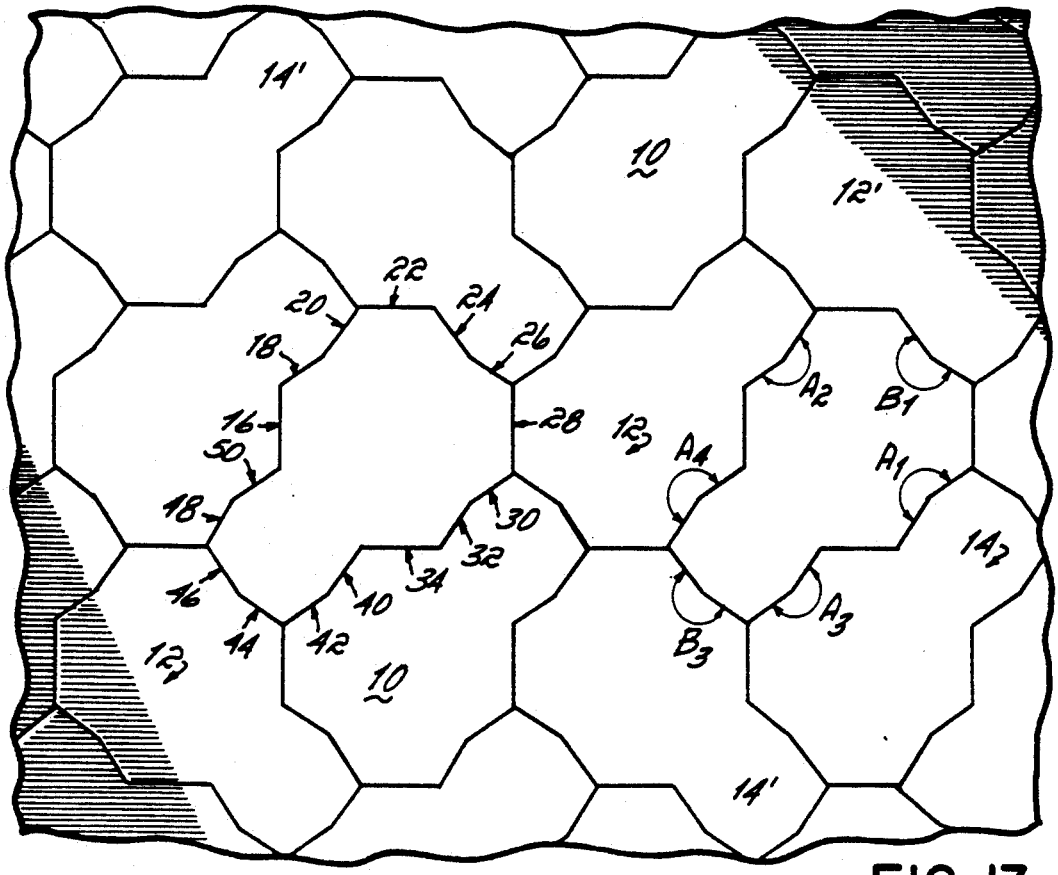
FIG. 13 is a top plan view of a modified 45° herringbone pattern laid with the paving stone of FIG. 1 of this invention.

To accomplish the basket weave or parquet pattern of FIG. 12 and the modified 45° herringbone pattern of FIG. 13, the relationships between the angles and sides of the main and tail sections which are requisite for laying the paving stone 10 in the herringbone pattern of FIG. 11 are also essential for laying the patterns of FIGS. 12 and 13.

To facilitate sufficient interlocking between adjacent stones when the paving stones 10 of the invention are laid in a pattern, it is necessary that angles $A_1$, $A_2$, $A_3$, $A_4$ of the stone of this invention lie in the collective range of approximately 120°-165° and 195°-240°. In accordance with this invention the angles $A_1$, $A_2$, $A_3$, $A_4$ should not lie in the approximate range of 165°-195°, otherwise insufficient interlocking between adjacent paving stones of a pattern will result. Similarly, it is essential for the paving stone of this invention to achieve sufficient interlocking between adjacent paving stones when the paving stones are laid in a pattern that the angles $B_1$, $B_2$ lie in the collective range of approximately 120°-165° and 195°-240°. The angles $B_1$, $B_3$ cannot in accordance with the principles of this invention lie in the approximate range of 165°-195°, otherwise insufficient interlocking will result between adjacent paving stones when the paving stones of this invention are laid in a pattern.

If the angles $A_3$, $A_4$ and angle $B_3$ are less than approximately 120°, the corners of the tail section defined by sides 42, 44 and 46, 48 become too pointed, with the result that undue breakage at these corners can occur. Similarly, if the angles $A_2$, $A_1$, $B_1$ exceed approximately 240°, the portion of the main section bounded by sides 20, 22, 24 and the portion of the main section bounded by sides 26, 28, 30 are prone to undue breakage.

Figure 2:
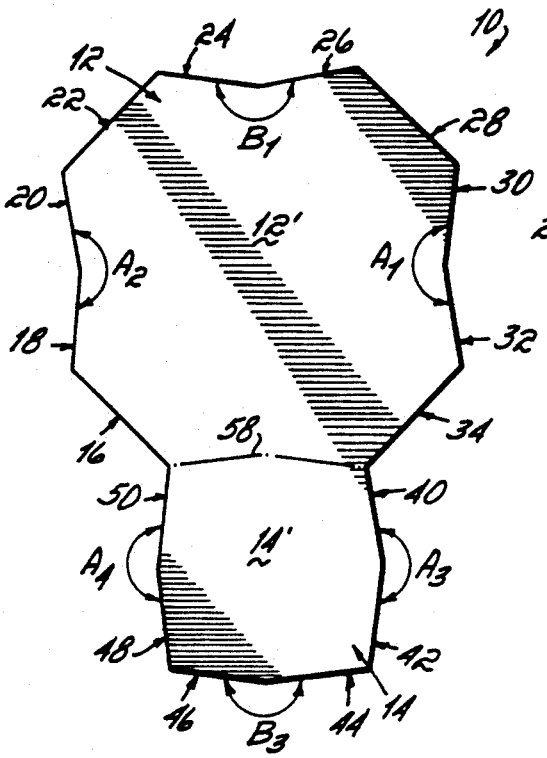
FIG. 2 is a top plan view of the paving stone of this invention in which the opposite sides of the main section thereof have the minimum permissible degree of concavity, with the ratio of the lengths of the long and short side segments thereof being approximately $1\frac{3}{8}$:1.

The paving stone illustrated in FIG. 2, in which the first pair of sides 30, 32 and the second pair of sides 18, 20, collectively defining the opposite sides of the main section, are concave to define respective angles $A_1$, $A_2$ of 195., represents the minimum degree of concavity for the opposite sides of the main section possible with this invention while still achieving sufficient interlock between adjacent paving stones.

Figure 4:
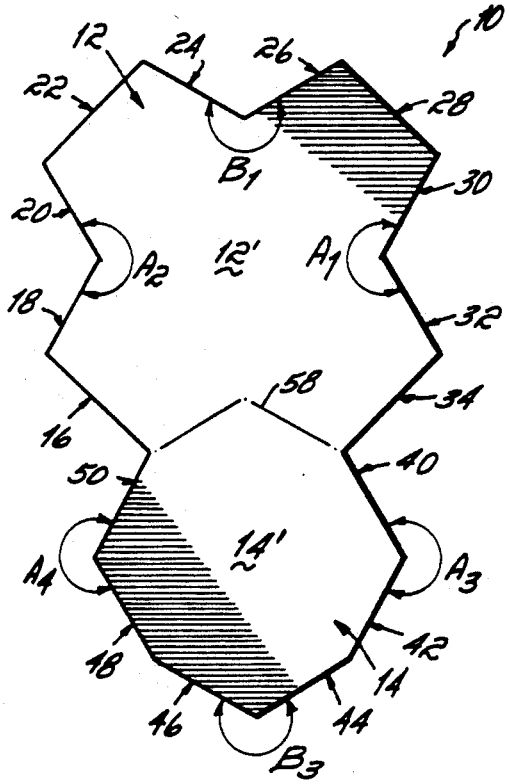
FIG. 4 is a top plan view of the paving stone of this invention in which the opposite sides of the main section thereof are provided with the maximum permissible degree of concavity, with the ratio of the lengths of the long and short side segments thereof being approximately $1\frac{3}{8}$:1.

In FIG. 4 wherein the opposite sides 18, 20 and 30, 32 of the main section are concave, their respective angles, $A_1$, $A_2$ are at approximately 240°, which represents the maximum concavity possible without rendering susceptible to undue breakage the main section components defined by sides 20, 22, 24 and sides 26, 28, 30.

Figure 3:
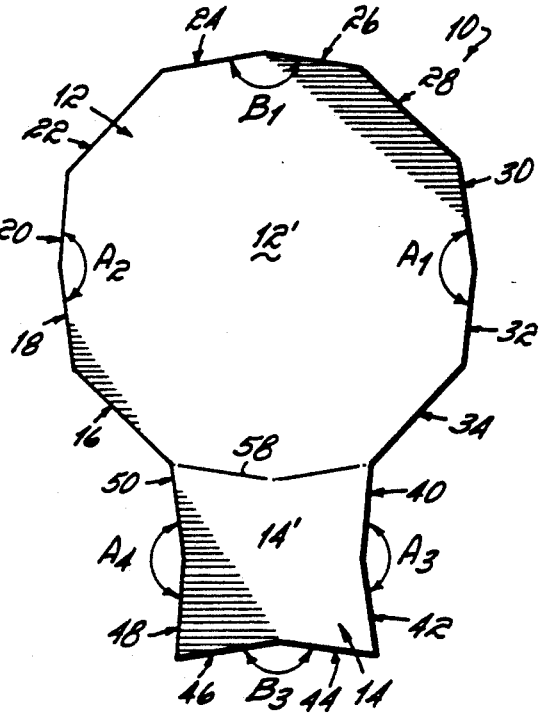
FIG. 3 is a top plan view of the paving stone of this invention in which the opposite sides of the main section thereof have the minimum permissible degree of convexness, with the ratio of the lengths of the long and short side segments thereof being approximately $1\frac{3}{8}$:1.

In FIG. 3 wherein the sides 30, 32 and 18, 20 of the main section are convex, the angles $A_1$, $A_2$ are approximately 165°, which represents the minimum convexness possible while still producing sufficient interlock between adjacent paving stones when the stone of this invention is laid in a pattern.

Figure 5:
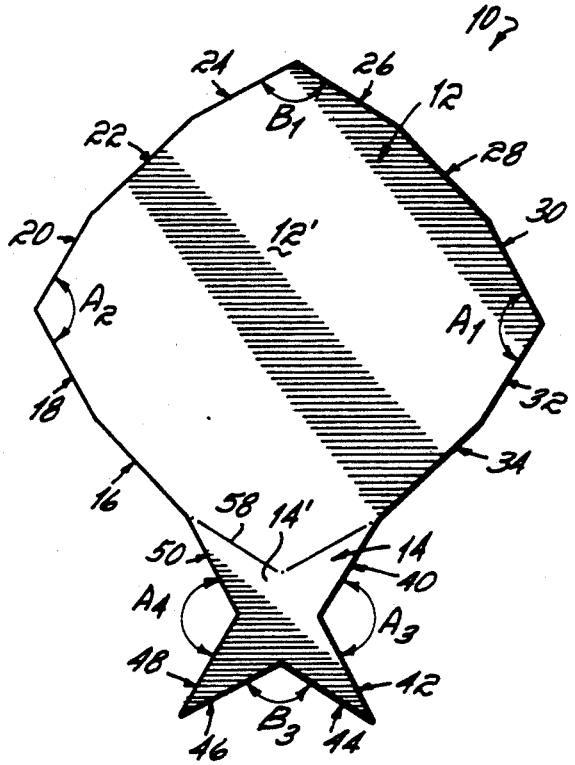
FIG. 5 is a top plan view of the paving stone of this invention in which the opposite sides of the main section thereof are provided with the maximum permissible degree of convexness, with the ratio of the lengths of the long and short side segments thereof being approximately $1\frac{3}{8}$:1.

In FIG. 5 the angles $A_1$, $A_2$ defined by opposite pairs of sides 30, 32 and 18, 20 of the main section, are approximately 120°, which defines the maximum degree of convexness possible without producing unduly pointed tail corners defined by sides 48, 46 and sides 42, 44, which if permitted to occur will render the paving stone susceptible to undue breakage of these corners.

Figure 6:
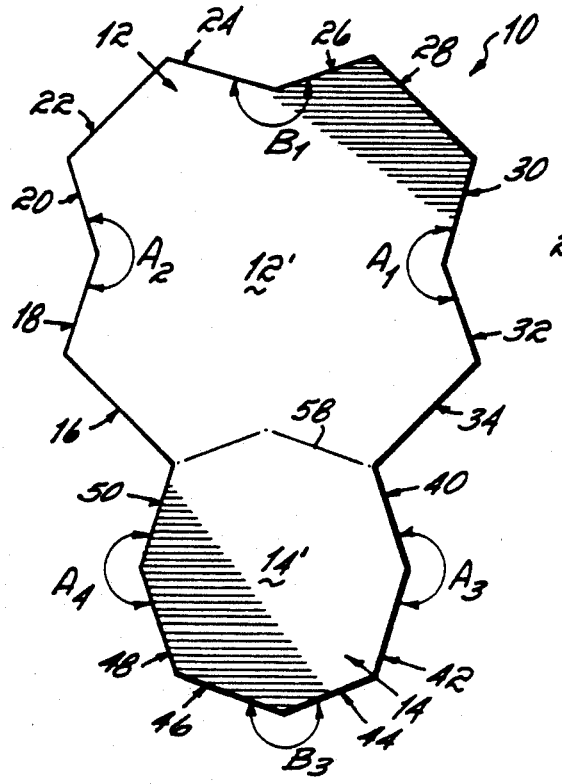
FIG. 6 is a top plan view of the paving stone of this invention in which the opposite sides of the main section thereof have a degree of concavity intermediate the minimum and maximum permissible in accordance with the invention, with the ratio of the lengths of the long and short side segments thereof being approximately $1\frac{3}{8}$:1.
Figure 7:
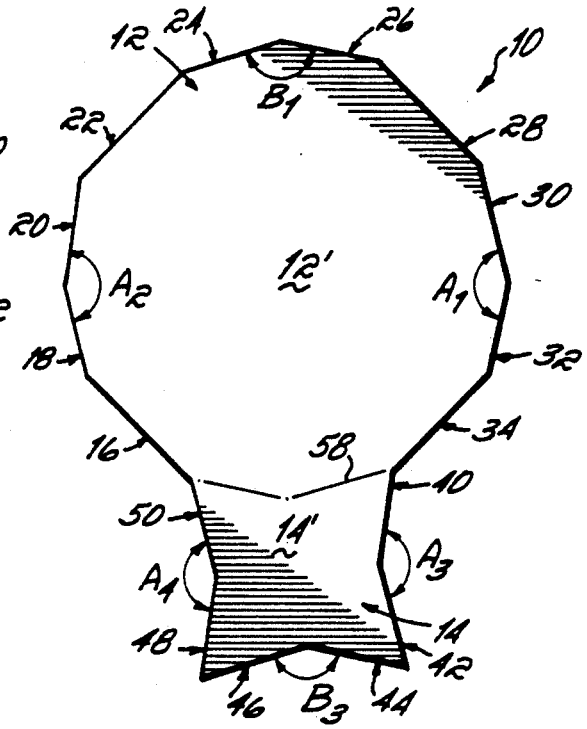
FIG. 7 is a top plan view of the paving stone of this invention in which the opposite sides of the main section thereof are provided with a degree of convexness which is intermediate the minimum and maximum permissible levels, with the ratio of the lengths of the long and short side segments thereof being approximately 1⅜:1.

The paving stones of FIGS. 6 and 7 have angles $A_1$ and $A_2$ of 217° and 140°, respectively, which represent degrees of concavity and convexity, respectively, lying between the limits for concave stones shown in FIGS. 2 and 4 and the limits for convex stones shown in FIGS. 3 and 5, respectively.

Figure 8:
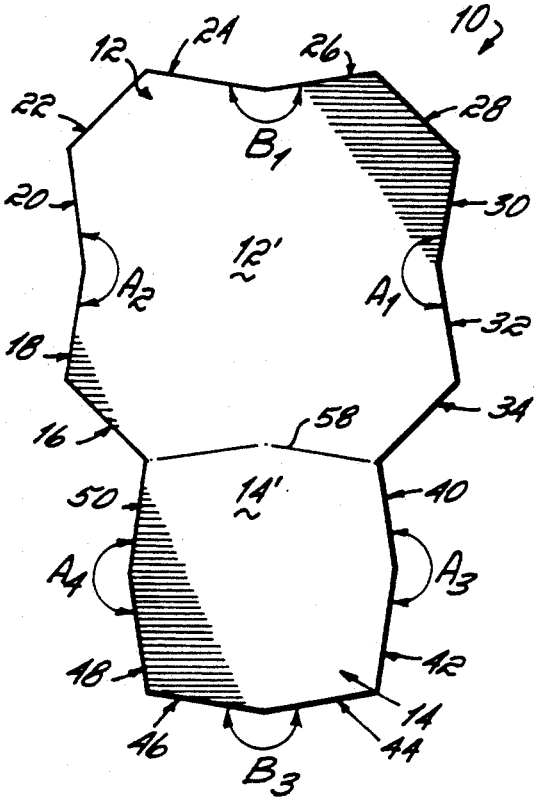
FIG. 8 is a top plan view of the paving stone of this invention with the side segments of the main and tail sections having equal length.

In the paving stone shown in FIGS. 1, 2, 3, 4, and 5, the length of each of the intermediate sides 16, 22, 28, 34 of the main section with respect to the length of each of the sides 18, 20, 24, 26, 30, 32, 36, 38 of the main section and the tail section sides 40, 42, 44, 46, 48, 50 represents a ratio of approximately a ⅜:1, which is preferred. In the paving stone shown in FIG. 8 the intermediate sides 16, 22, 28, 34 are approximately equal in length to the sides 30 and 32, 18 and 20, and 24 and 26 which define the angles $A_1$, $A_2$, $B_1$, respectively, as well as the sides 40 and 42, 44 and 46, and 48 and 50 of the tail which define the angles $A_4$, $B_3$, $A_3$, respectively.

Figure 9:
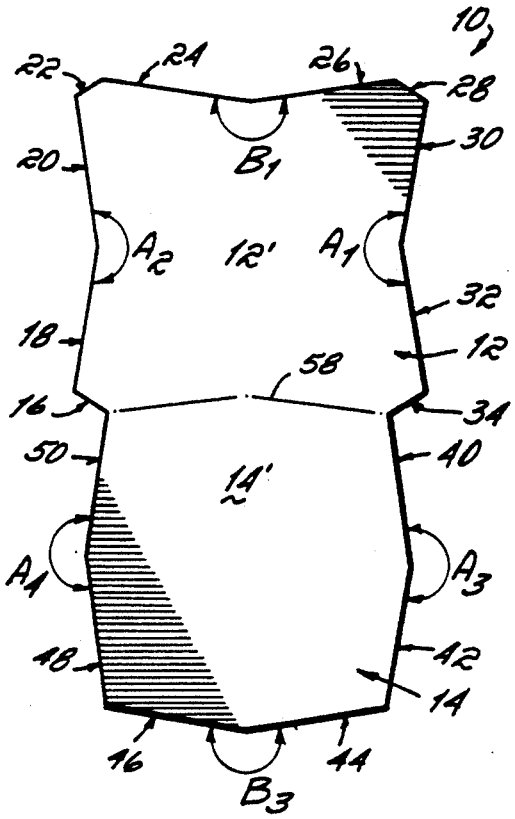
FIG. 9 is a top plan view of the paving stone of this invention with the ratio of the lengths of the longer and shorter side segments of the main section being approximately 4:1.

In the paving stone of FIG. 9, the intermediate sides 16, 22, 28, 34 of the main section 12 are approximately one-fourth the length of the sides 30 and 32, 18 and 20, and 24 and 26 which define the angles $A_1$, $A_2$, $B_1$ of the main section and the sides 40 and 42, 44 and 46, and 48 and 50 of the tail section 14 which define the angles $A_3$, $B_3$, $A_4$.

Preferably, the ratio of the length of the intermediate sides 16, 22, 28, 34 of the main section 12 with respect to the remaining sides of the paving stone is approximately 1⅜:1, as shown in FIGS. 1–7. It is desired that the ratio of the length of the intermediate sections 16, 22, 28, 34 of the main section with respect to the length of the remaining sides of the paving stone should lie somewhere in the approximate range of ¼:1 and 2:1. The degree of interlock between adjacent stones is undesirably reduced and the shorter sides tend to be susceptive to undue chipping when the ratio of the length of sides 16, 22, 28 and 34 relative to the remaining sides becomes undesirably small, that is, below approximately ¼:1. If the ratio of the length of sides 16, 22, 28 and 34 becomes undesirably large, that is, greater than approximately 2:1, corners form which are susceptive to breakage.

Figure 15:
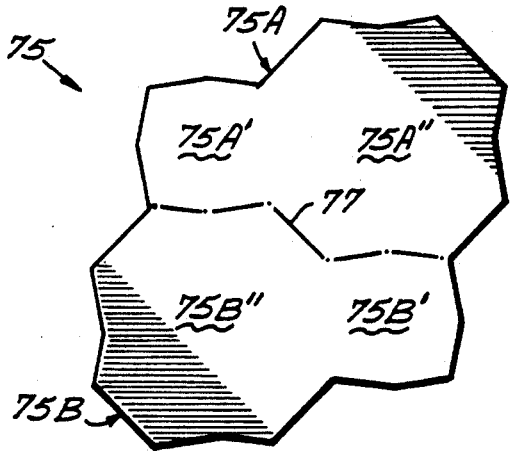
FIG. 15 is a top plan view of a "double" stone incorporating integral sections each identically shaped to the stone of FIG. 1, scaled down and oriented oppositely to each other such that the overall length approximates that of the "single" stone of FIGS. 1-9.
Figure 16:
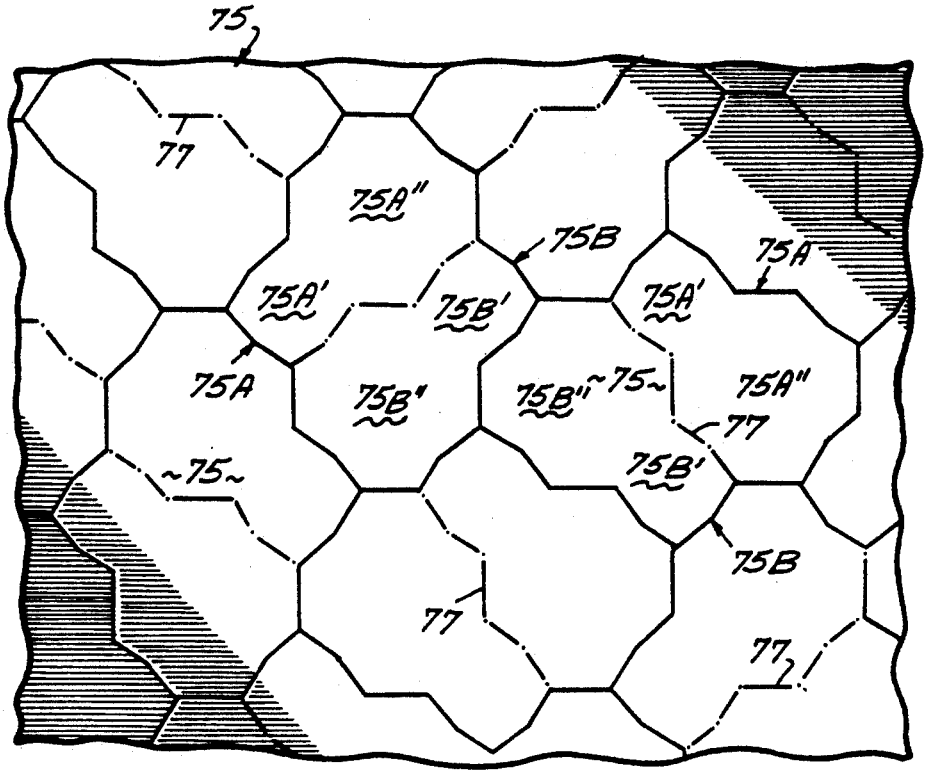
FIG. 16 is a top plan view of a herringbone pattern comprised of "double" stones of FIG. 15.

Preferably, the "single" stone of FIGS. 1–14 and the "double" stone of FIGS. 15 and 16 have a maximum overall length of 10" and a maximum overall width of 5", to enable the stones to be conveniently manually laid in a pattern by an artisan or paving stone contractor.

In accordance with a further embodiment of the invention shown in FIG. 15, a "double" stone 75 comprising two of the "single" stones of FIG. 1 formed integral with each other can be provided. In accordance with this embodiment, the "double" stone 75 includes first and second paving stone sections 75A and 75B which are integral with each other and each identically shaped and dimensioned with respect to each other. Stone sections 75A and 75B, like, for example, the stone 10 of FIG. 1, each include tail sections 75A' and 75B', respectively, and main sections 75A" and 75B", respectively. The side length and angular relationships for identical stone sections 75A and 75B of the "double stone" 75 are the same as those described in connection with the "single" stone of FIGS. 1–14, except for the fact that the lengths of the sides of the integral stone sections 75A and 75B of the "double" stone 75 are scaled down relative to the lengths of the sides of the "single" stone 10 such that the overall length of stone 75 is approximately that of stone 10. Preferably, the overall length of stone 75 does not exceed approximately 10" and the overall width does not exceed approximately 5". The "double" stone 75 of FIG. 15 has its identical stone sections 75A and 75B oriented such that the right side of the tail and main sections of one of stone sections 75A is adjacent the right side of the main and tail sections, respectively of the other stone section 75B in a manner analogous to a runner pattern with adjacent courses running in opposite directions. Preferably, a false joint 77 is provided between the integral sections 75A and 75B of the "double" stone 75.

Figures 17, 18:
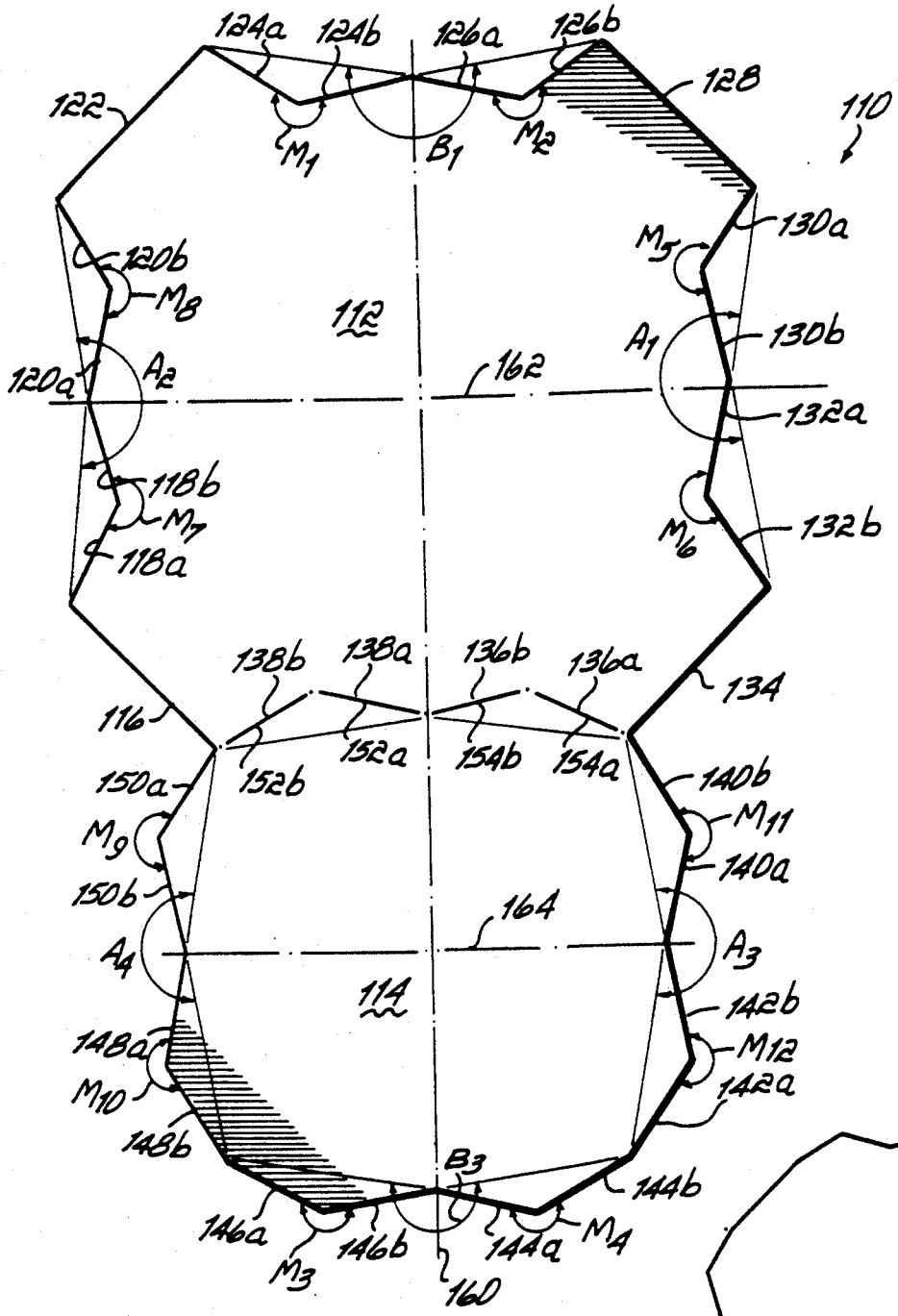
FIG. 17 is a top plan view of a still further embodiment of the invention.
FIG. 18 is a top plan view of a paving stone similar to the embodiment of FIG. 17.

In the embodiment shown in FIG. 17, the paver 110 has a main section 112 and a tail section 114. The main section 112, like the main section of the embodiments of FIGS. 1–14, includes four intermediate sides 116, 122, 128 and 134 which are preferably oriented at 45° to a longitudinal plane of symmetry 160. However, in the embodiment of FIG. 17 instead of having a pair of straight sides, either convexly or concavely arranged, between each pair of intermediate sides as in FIG. 1, four sets of interconnected sides are provided between each pair of intermediate sides 116, 122, 128 and 134 of the main section 112. Similarly, instead of having a tail provided with eight sides, as in the embodiment of FIG. 1, a pair of sides is provided in the tail 114 of the embodiment of FIG. 17 in place of each side of the octagonal tail section 14 of the embodiment shown in FIG. 1.

Referring to main section 112 of paver 110, between each pair of intermediate sides 122–128, 128–134, 134–116, and 116–122, are provided a set of four interconnected sides. Sides **124*a* and 124*b* and sides 126*a* and 126*b*, constituting a third set, are provided between intermediate sides 122 and 128. Sides 124*a* and 124*b* and sides 126*a* and 126*b* of the embodiment of FIG. 17 correspond to sides 24 and 26 respectively, of the embodiment of FIG. 1 which are located between intermediate sides 22 and 28. Similarly, with the embodiment of FIG. 17, two pairs of sides 130*a*, 130*b* and 132*a*, 132*b* constituting a first set, are provided between intermediate sides 128 and 134. Sides 130*a*, 130*b* and sides 132*a*, 132*b* correspond to sides 30 and 32, respectively, of the paver of FIG. 1. Two pair of sides 138*a*, 138*b* and 136*a*, 136*b*, constituting a fourth set, are provided between intermediate sides 116 and 134, which correspond to sides 138 and 136 of FIG. 1. Finally, two pair of sides 118*a*, 118*b* and 120*a*, 120*b*, constituting a second set, are provided between intermediate sides 116 and 122, which correspond to sides 16 and 22 of FIG. 1**.

The tail section 114 of the embodiment of FIG. 17 is provided with eight pairs of sides, namely, **136*a* and 136*b*, 138*a* and 138*b*, 140*a* and 140*b*, 142*a* and 142*b*, 144*a* and 144*b*, 146*a* and 146*b*, 148*a* and 148*b*, and 150*a* and 150*b*. To enable the third set of sides of the end of the tail section 114 to interlock with the third set of sides of the end of the main section 112, when adjacent stones are laid in interlocking end-to-end relation for runner patterns, the length of the sides 124*a* and 124*b* of the main section must equal the length of the sides 146*a* and 146*b* of tail section 114 and the concave external angle between the sides 124*a* and 124*b* must equal the concave internal angle between the sides 146*a* and 146*b*. Similarly, the length of sides 126*a* and 126*b* must equal the length of sides 144*a* and 144*b*, respectively, and the external angle formed by concave sides 126*a* and 126*b* must equal the internal angle formed by convex sides 144*a* and 144*b***.

To enable the sides of tail section 114 to interlock with the sides of main section 112, as is desirable to enable FIG. 17 to be laid in runner patterns, with adjacent courses either in the same direction or opposite directions, it is necessary that the first set of tail section sides **140*a*, 140*b*, 142*a* and 142*b* mesh with the first set of main section sides 130*a*, 130*b*, 132*a*, and 132*b* as well as with the second set of main section sides 118*a*, 118*b*, 120*a* and 120*b*. Similarly, it is essential that the second set of tail section sides 148*a*, 148*b*, 150*a* and 150*b* mesh with the first set of main section sides 130*a*, 130*b*, 132*a* and 132*b* as well as with the second set of main section sides 118*a*, 118*b*, 120*a* and 120*b*. To achieve runner bond, it is not necessary that the tail section be symmetrical about transverse plane 164 nor that the main section be symmetrical about transverse plane 162, nor that the stone be symmetrical about longitudinal plane 160. However, such symmetry is preferable. For example, it is necessary that sides 146*a*, 146*b*, 144*a* and 144*b* mesh with sides 124*a*, 124*b*, 126*a* and 126*b*, respectively, such meshing can occur without symmetry about longitudinal plane 160. Stated differently, such meshing can occur if sides 124*a* and 124*b* are congruent with sides 146*a* and 146*b*, respectively, and if sides 126*a* and 126*b* are congruent with sides 144*a* and 144*b*, respectively, notwithstanding that sides 124*a* and 124*b* are not symmetrical with sides 126*a* and 126, and further notwithstanding that sides 146a and 146b are not symmetrical with sides 144a and 144b. However, it is preferred that sides 124a and 124b are symmetrical with sides 126a and 126b, and that sides 146a and 146b are symmetrical with sides 144a and 144b**.

The paving stone of FIGS. 17 and 18 can be laid in interlocking end-to-end relation for runner patterns, with adjacent courses either in the same direction or opposite directions with their longitudinal planes in spaced parallel relation, with the ends of the main section of one stone meshing with the end of the tail section of an adjacent stone, and with the sides of the main and tail sections of one stone meshing with the sides of the tail and main sections of an adjacent stone, respectively.

Figure 19:
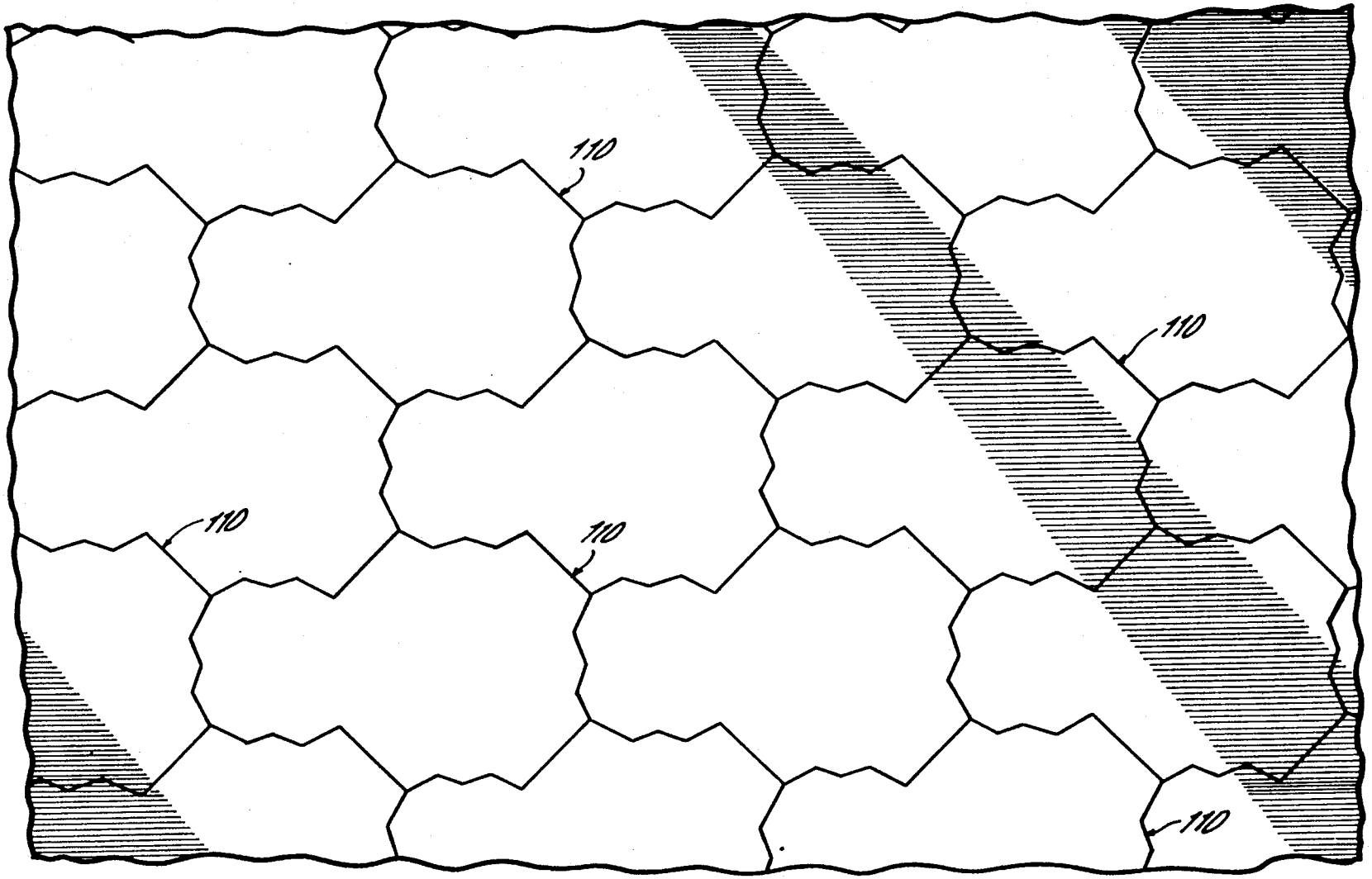
FIG. 19 is a top plan view of a runner pattern laid with the paving stone of FIG. 17 of this invention.

FIG. 19 depicts the stone of FIG. 17 laid in a runner pattern wherein the adjacent courses are in the same direction, which corresponds to the runner pattern shown in FIG. 10 for the stone of FIG. 1.

Figure 20:
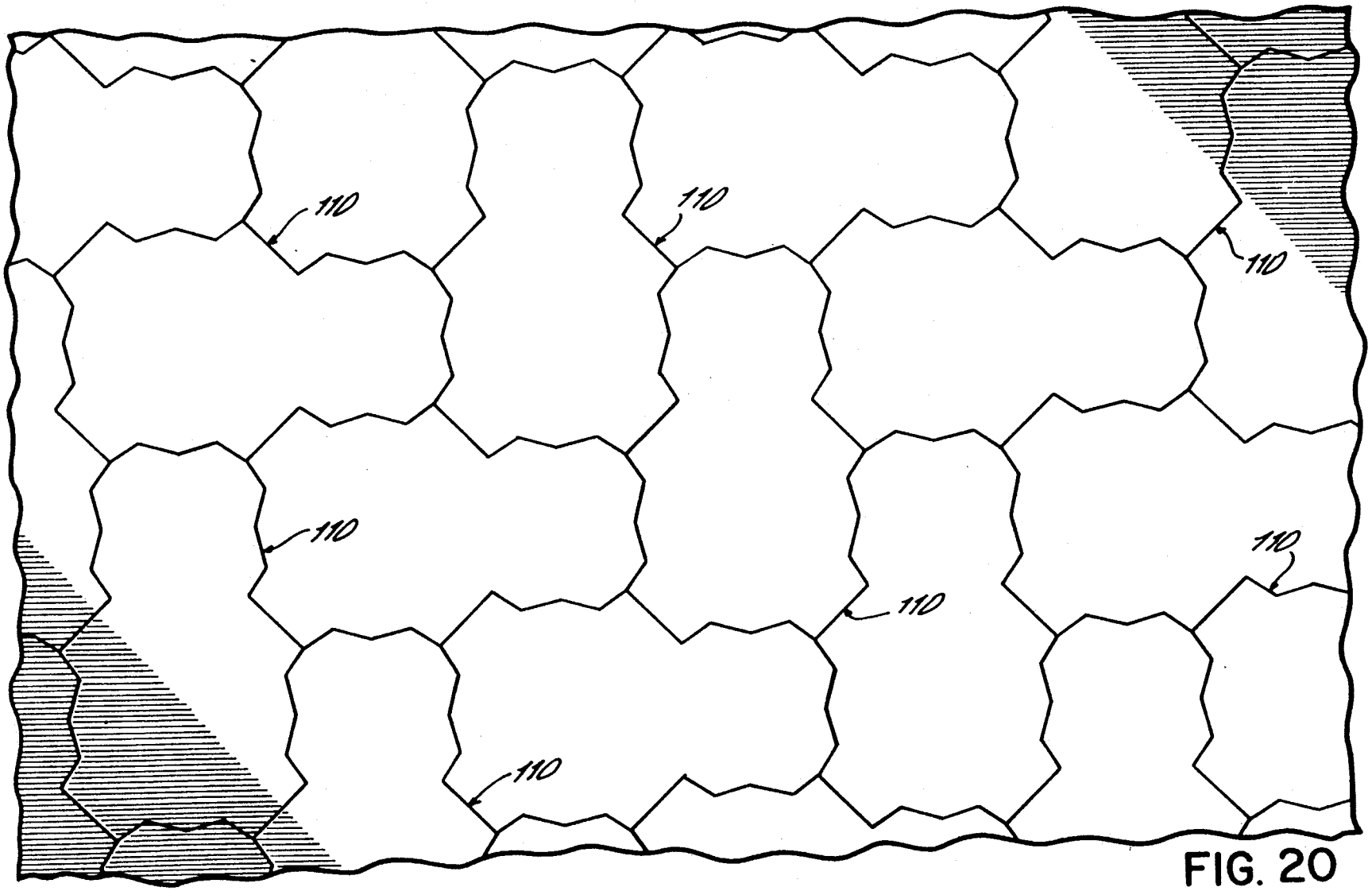
FIG. 20 is a top plan view of a 90° herringbone pattern laid with the paving stone of FIG. 17 of this invention.

The paving stone of FIGS. 17 and 18 can be laid in a herringbone pattern wherein the longitudinal planes of some adjacent stones are in spaced parallel relation and the longitudinal planes of other adjacent stones are in nonparallel relation. FIG. 20 depicts the stone of FIG. 17 laid in herringbone pattern.

Figure 21:
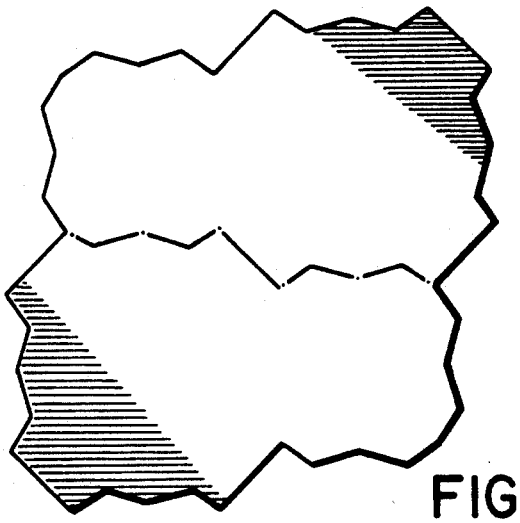
FIG. 21 is a top plan view of a "double" stone incorporating integral sections each identically shaped to the stone of FIG. 17, scaled down and oriented oppositely to each other such that the overall length approximates that of the "single" stone of FIG. 17.
Figure 22:
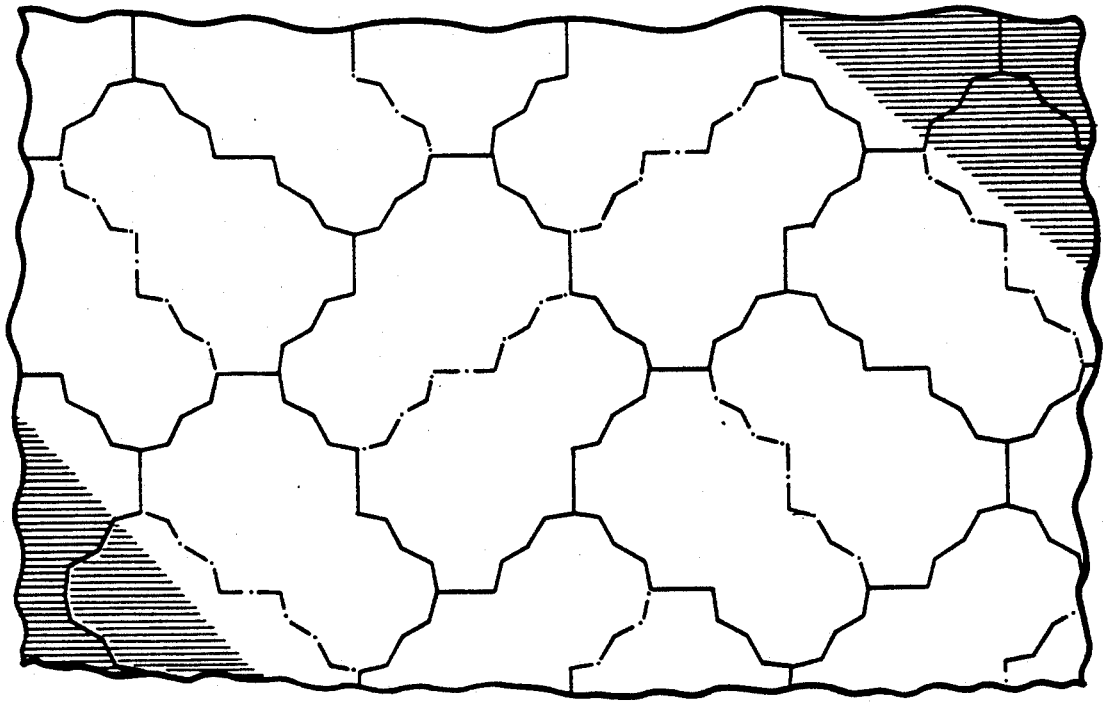
FIG. 22 is a top plan view of a herringbone pattern comprised of the "double" stones of FIG. 21.

The single stone of FIGS. 17 and 18, like the single stones of the other embodiments, can be made as an integral pair to form a double stone, such as shown in FIG. 21 for the stone of FIG. 17, which corresponds to the double stone of FIG. 15. The double stone of FIG. 21, like the double stone of FIG. 15, can be laid in a variety of patterns, including a herringbone pattern as shown in FIG. 22, which corresponds to the herringbone pattern shown in FIG. 16 for the double stone of FIG. 15.

Similarly, to accomplish runner patterns, it is necessary only that sides 130a and 130b, 118a and 18b, 150a and 150b, and 142a and 142b, be congruent. And, further that sides 120a and 120b, 148a and 148b, 132a and 132b, and 140a and 140b, be congruent. However, it is not necessary that sides 130a and 130b be congruent with sides 132a and 132b, or that sides 140a and 140b be congruent With 142a and 142b, or that sides 148a and 148b be congruent with sides 150a and 150b, or that sides 120a and 120b be congruent with sides 118a and 118b, although such congruence is preferred such that the main section 112 will be symmetrical about transverse plane 162 and the tail section 114 will be symmetrical about transverse plane 164.

To enable the stone of FIG. 17 to be laid in a herringbone pattern, in addition to the relationships set forth above for runner patterns, it is further necessary that the end of the tail section formed by sides 146a, 146b, 144a and 144b mesh with the side of the main section formed by sides 130a, 130b, 132a and 132b and with the side of the main section formed by sides 118a, 118b, 120a and 120b. It is also necessary that the main end formed by sides 124a, 124b, 126a and 126b mesh with the side of tail section formed by sides 140a, 140b, 142a and 142b as well as with the side of tail section formed by sides 150a, 150b, 148a and 148b. While the meshing described as necessary for herringbone patterns can be accomplished without symmetry about longitudinal plane 160 and symmetry about transverse planes 162 and 164, such symmetry is preferred.

To enable the stone 110 of FIG. 17 to be laid in herringbone pattern, it is essential that the intermediate sides 116, 122, 128 and 134 of the main section be angled at substantially 45° of the longitudinal plane of symmetry 160.

It is also essential, for both herringbone and nonherringbone patterns, that the external angles formed by sides 124a and 124b, 126a and 126b, 130a and 130b, 132a and 132b, 118a and 118b, and 120a and 120b, all be either concave or convex. Similarly, it is essential that the internal angles formed by sides 140a and 140b, 142a and 142b, 144a and 144b, 146a and 146b, 148a and 148b, and 150a and 150b, be either all concave or all convex. It is also essential that the external angles of the main section defined immediately above and the internal angles of the tail section defined immediately above be either all concave or all convex. For example, in the preferred embodiment shown in FIG. 17, the external angles of the main section are all concave and the internal angles of the tail section are all concave. It is possible that a stone incorporating the invention of the embodiment of FIG. 17 could be configured in which the external angles of the main section and the internal angles of the tail section are all convex. Such a stone is shown in FIG. 18, wherein "200" series reference numbers correspond with "100" series reference numbers.

Another way of viewing the stone of FIG. 17 vis-a-vis the stone of FIG. 1 is that each of the first, second and third pairs of sides 30 and 32, 18 and 20, and 24 and 26, respectively, of FIG. 1, as well as each of the first, second and third pairs of sides of the tail section 40 and 42, 48 and 50, and 44 and 46, respectively, of FIG. 1, have been replaced by a set of four sides, with each set of four sides including an inner pair of connected sides and an outer pair of sides between which are connected the inner pair of sides. For example, and with reference to the outer end of the main section 112 of the paver 110 shown in FIG. 17, the end includes a set of four sides 124a, 124b, 126a and 126b which includes an inner set of interconnected sides 124b and 126a and an outer pair of sides 124a and 126b between which are connected the inner pair of sides 124b and 126a. Viewed in this manner, it is essential that the angle formed by the inner pair of sides 124b and 126a be convex (concave) when the angles formed by sides 124a and 124b and by sides 126a and 126b are concave (convex) or vice versa. A similar requirement exists with respect to the four-sided sets 118a, 118b, 120a, 120b; and four-sided sets 130a, 130b, 132a, 132b. The same requirement applies with respect to the four-sides sets of the tail section 114, namely, the set including sides 150a, 150d, 148a and 148b; the set consisting of sides 144b, 144a, 146b and 146a; and the set consisting of sides 140a, 140b, 142a and 142b.

To assure an adequate degree of interlock between adjacent pavers of the type shown in FIGS. 17 and 18, the internal angles $M_1$ and $M_2$ and the external angles $M_3$ and $M_4$ of the ends of the main and tail sections 112, and 114, respectively, should lie in the range collectively defined by the subranges of approximately 120°-165° and 195°-240°. Similarly, internal angles $M_5$, $M_6$, $M_7$ and $M_8$ of the sides of main section 112 and external angles $M_9$, $M_{10}$, $M_{11}$, and $M_{12}$ of the sides of tail section 11 should be in the range collectively defined by the subranges of approximately 120°-165° and 195°-240°.

Angles B $B_3$, and $A_1$, $A_2$, $A_3$ and $A_4$ of the paver of FIG. 1 have been superimposed on the paver of FIG. 17 to depict the manner in which certain aspects of the two pavers are similar. As it will be recalled, with the paver of FIG. 1, to insure adequate interlocking, internal angles $B_1$, $A_1$, $A_2$ and external angles $B_3$, $A_3$ and $A_4$ were in the range collectively defined by the subranges of approximately 120°-165° and 195°-240°. The range for the recited angles of the paver of FIGS. 17 and 18 is the same range as for the recited angles of the paver of FIG. 1.

In FIG. 18, each of the four sets of four sides of main section 112 can be viewed as having a shape corresponding to the letter "W," while each of the sets of four sides of tail section 114 can be viewed as having the shape of the letter "M." This occurs when the angles $M_1$ through $M_{12}$ be in the approximate subrange of 120°-165°. It is also possible to reverse the "M" and "W" letter shapes such that angles $M_1$-$M_{12}$ are in the approximate subrange of 195°-240°, producing the paver 210 configuration of FIG. 18. The paver 110 of FIG. 17 provides noticeably better interlock than the paver 210 of FIG. 18 and is preferred as between these two configurations.

What is claimed is:

1. A paving stone comprising:

integral substantially coplanar main and tail sections of substantially uniform thickness measured between the upper and lower surfaces thereof, said paving stone being substantially symmetrical about a longitudinal plane bisecting said main and tail sections, said main section having twenty substantially straight sides including first, second, third and fourth sets of four interconnected sides each, with each set having an inner pair of equal length sides connected to each other and an outer pair of equal length sides between which said inner pair of sides are connected, said first and second sets being located on opposite sides of said longitudinal plane of symmetry, said third and fourth sets being disposed on opposite sides of said main section along said plane of symmetry, said third and fourth sets being disposed between said first and second sets with said third and fourth sets being located remote and adjacent said tail section, respectively, said main section further including first, second, third and fourth substantially equal length intermediate sides which are not connected to each other, said first and second intermediate sides being substantially parallel to each other and said third and fourth intermediate sides being substantially parallel to each other, said first and third intermediate sides being located on opposite sides of and substantially symmetrical to said plane of symmetry with said third set of sides being located between said first and third intermediate sides, said first and third intermediate sides being remote from said tail section, said second and fourth intermediate sides being disposed on opposite sides of, and substantially symmetrical to, said plane of symmetry with said fourth set of sides being located between said second and fourth intermediate sides, said second and fourth intermediate sides extending from said tail section, said tail section including sixteen substantially straight interconnected sides, said sixteen tail section sides defining first, second, third and fourth sets of sides with each set including an inner pair of equal length sides connected to each other and an outer pair of equal length sides between which are connected said inner pair of sides, said first and second sets of sides of said tail section being on opposite sides of, and substantially symmetrical to, said plane of symmetry, said third and fourth sets of sides of said tail section being located along said plane of symmetry between said first and second sets of sides of said tail section with said fourth set of sides adjacent said main section and common to said fourth set of sides of said main section, said third set of sides of said tail section being located between said first and second sets of sides of said tail section and remote from said main section, each of said fourth set of sides of said main and tail sections being internal and common to said paving stone whereby they are not exposed, each of said first, second and third sets of sides of said main and tail sections being external to said paving stone whereby they are exposed, and each internal angle of the main section formed by the connection of a side of an inner pair of sides with the side of an outer pair of sides being either all concave or all convex, and each external angle of the tail section formed by the connection of a side of an inner pair of sides with a side of an outer pair of sides being either all concave or all convex, with said internal angels of said main section and aid external angles of said tail section being either all concave or all convex, said internal angles of said main section and said external angles of said tail section lying in the range collectively defined by the subranges of approximately 1200°-1650° and 1950°-240°, the third set of sides of said main and tail sections being capable of meshing when identical adjacent stones are laid in interlocked end-to-end relation with their respective longitudinal planes of symmetry coplanar, and said first and second sets of sides of said main section each being capable of meshing with each of said first and second sets of sides of said tail section when identical adjacent stones are laid in interlocking side-by-side relation with their respective longitudinal planes in spaced parallel relationship.

2. The paving stone of claim 1 wherein the length of the sides of said third set of each of said main and tail sections are all equal to each other, and wherein the length of the sides of each of said first and second sets of said main and tail sections are all equal to each other.

3. The paving stone of claim 2 wherein said third set of sides of said tail section mesh with the first and second sets of sides of said main section when identical adjacent stones are laid in a herringbone pattern with their respective longitudinal planes of symmetry in substantially nonparallel relation, and wherein said third set of sides of said main section can mesh with first and second sets of sides of said tail section when adjacent stones are laid in said herringbone pattern with their longitudinal planes of symmetry in nonparallel relation, and wherein said intermediate sides of said main section are angled at substantially 45° to said longitudinal plane of symmetry.

4. The paving stone of claim 1 or claim 2 or claim 3 wherein the external angle formed by the inner pair of equal length sides of each of said first, second and third sets of interconnected sides of said main section is convex, and wherein the external angle formed by the inner pair of equal length sides of each of said first, second and third sets of interconnected sides of said tail section is concave.

5. The paving stone of claim 1 or claim 2 or claim 3 wherein the external angle formed by the inner pair of equal length sides of each of said first, second and third sets of interconnected sides of said main section is concave, and wherein the external angle formed by the inner pair of equal length sides of each of said first, second and third sets of interconnected sides of said tail section is convex.

6. An integral double paving stone comprising a pair of single paving stones of claim 1 disposed with (a) their respective longitudinal planes in spaced parallel relationship, (b) with the second sets of sides of said main and tail sections of one stone being integrally connected to the second sets of sides of said tail and main sections of the other stone, respectively, said integrally connected sets of sides being common and unexposed, and (c) with the second intermediate side of each of said stones being integrally connected, common, and unexposed.

7. The double paving stone of claim 6 wherein the length of the sides of each of said first and second sets of said main and tail sections are all equal to each other.

8. The double paving stone of claim 7 wherein said third set of sides of said main section can mesh with first and second sets of sides of said tail section when adjacent stones are laid in said herringbone pattern with their longitudinal planes of symmetry in nonparallel relation, and wherein said intermediate sides of said main section are angled at substantially 45° to said longitudinal plane of symmetry.

9. The double paving stone of claim 6 or claim 7 or claim 8 wherein the external angle formed by the inner pair of equal length sides of each of said first, second and third sets of interconnected sides of said main section is convex, and wherein the external angle formed by the inner pair of equal length sides of each of said first, second and third sets of interconnected sides of said tail section is concave.

10. The double paving stone of claim 1 or claim 2 or claim 3 wherein the external angle formed by the inner pair of equal length sides of each of said first, second and third sets of interconnected sides of said main section is concave, and wherein the external angle formed by the inner pair of equal length sides of each of said first, second and third sets of interconnected sides of said tail section is convex.

* * * * *